US007945981B2

(12) United States Patent
Lapping

(10) Patent No.: US 7,945,981 B2
(45) Date of Patent: May 24, 2011

(54) AUTOMATIC POOL CLEANER WITH FLEXIBLE SCRUBBING PANEL

(76) Inventor: Harold Lapping, Rockville, MD (US)

( * ) Notice: Subject to any disclaimer, the term of this patent is extended or adjusted under 35 U.S.C. 154(b) by 1007 days.

(21) Appl. No.: 11/812,645

(22) Filed: Jun. 20, 2007

(65) Prior Publication Data

US 2007/0294846 A1 Dec. 27, 2007

Related U.S. Application Data

(60) Provisional application No. 60/815,273, filed on Jun. 21, 2006.

(51) Int. Cl.
*E04H 4/16* (2006.01)

(52) U.S. Cl. ..... 15/1.7; 15/231

(58) Field of Classification Search ..... 15/147.1, 15/104.92, 1.7, 228, 231
See application file for complete search history.

(56) References Cited

U.S. PATENT DOCUMENTS 2,333,829 A 11/1943 Terry
3,676,884 A 7/1972 Wulc
3,790,979 A 2/1974 Foster
4,027,352 A 6/1977 Wagner
4,152,801 A 5/1979 Lieber
4,154,680 A 5/1979 Sommer
4,682,558 A 7/1987 Broersz
4,835,809 A 6/1989 Roumagnac
5,088,148 A * 2/1992 Hernandez ..... 15/228
6,212,725 B1 4/2001 Porat

* cited by examiner

*Primary Examiner* — Shay L Karls

(74) *Attorney, Agent, or Firm* — Birch, Stewart, Kolasch & Birch, LLP

(57) ABSTRACT

An automatic pool cleaner includes a housing having a bottom, an outer surface and an interior, at least two wheels connected to the housing and supporting the housing for rolling movement on a support surface with the bottom facing the support surface, a propulsion system in the interior configured to move the pool cleaner along the support surface, a suction inlet, and a scrubbing panel connected to the housing. The scrubbing panel includes at least one flexible panel and a resilient stiffener connected to the flexible panel that is configured to bias a planar portion of the flexible panel against the support surface when the wheels support the housing on the support surface.

15 Claims, 5 Drawing Sheets

AUTOMATIC POOL CLEANER WITH FLEXIBLE SCRUBBING PANEL

CROSS-REFERENCE TO RELATED APPLICATIONS

The present application claims the benefit of U.S. provisional patent application No. 60/815,273, filed Jun. 21, 2006, the entire contents of which are hereby incorporated by reference.

FIELD OF THE INVENTION

The present invention is directed to an automatic pool cleaner having a flexible scrubbing panel, and, more specifically, toward an automatic pool cleaner having a flexible scrubbing panel with a planar cleaning surface spring biased against the bottom of pool.

BACKGROUND OF THE INVENTION

Automatic pool cleaning devices are generally well known in the art for removing debris from swimming pools and reducing or eliminating the need for manual vacuuming. Many swimming pools include a water filtration system with a pump for drawing or suctioning water from the pool and circulating it through the system. The filter system may include a relatively large-pored filter basket for trapping debris such as leaves and twigs and a filter canister containing a filter media for trapping smaller particles including sand and silt. From the filter canister, the water is recirculated to the pool via one or more return lines.

Such filtration systems may be operated for several hours at a time on a daily basis and, in combination with traditional chemical treatments such as chlorination or the like, help keep the pool water clean. However, such water filtration systems are not particularly effective at removing debris that settles on the bottom or sides of the pool. In the past, settled debris has typically been removed by coupling a vacuum hose to the suction side of the pool water filtration system, to a skimmer well located near the water surface at one side of the pool for example, and then manually moving a vacuum head coupled to the hose over the submerged pool surfaces to vacuum settled debris directly to the filter canister where it is collected and separated from the pool water. However, manual vacuuming of a swimming pool is a labor intensive task that takes time away from enjoying the use of a swimming pool.

Many automatic pool vacuum systems have been developed over the years. Such systems may be powered by a pump pumping water to the cleaner, which systems use the venturi effect to draw dirt into the cleaner, or by the pool's skimmer system which draws water into and through the cleaner. In either case, the moving water may be used to power a turbine or similar device to convert the movement of the fluid into mechanical energy for driving the wheels and moving the cleaner in a more or less random pattern along the pool bottom. Alternately, the pool cleaner could be propelled by jetting fluid from the housing or by an electric motor.

FIGS. 9 and 10 illustrate, somewhat schematically, a conventional automatic pool cleaner that includes a housing 200 having a front 202, a rear 204 and a bottom 206. A front wheel 208 and a pair of rear wheels 210 support housing 200 for movement along the bottom 212 of a pool. A vacuum hose 214 connects the pool cleaner to a pool skimmer (not illustrated), and suction from the pool skimmer draws dirt and debris through suction inlet 216 and passage 218 to vacuum hose 214 and into the pool's filtration system (not illustrated). A second passage 220 connects a fluid drive mechanism 222 to vacuum hose 214 so that fluid drawn through drive mechanism 222 by the pool's filtration system turns a first gear 224 connected to a second gear 226 on rear wheel 210 to move the pool cleaner along the bottom 212 of the pool. Many other types of conventional automatic pool cleaners and propulsion systems are also known.

Vacuuming a pool, however, does not substantially affect algae and bacteria that can grow on pool surfaces. This is due in part to the fact that the bacteria adheres to the surfaces too tightly to be vacuumed off and partly due to the protective membrane that coats many types of bacteria and algae. To remove such material, it may be necessary to periodically manually scrub the bottom and sides of the pool, or to use high concentrations of chemicals to kill the algae.

Pool cleaners having motor driven brushes, such as disclosed in U.S. Pat. No. 4,154,680 to Sommer, for example, are known and may be generally effective for algae removal. However, the use of a motor to drive a brush adds to the cost and complexity of pool cleaners. It would therefore be desirable to provide a vacuum type automatic pool cleaner that provides benefits similar to those provide by more complex automatic cleaners having scrubbing brushes without the added cost and complexity of a motor driven scrubbing system.

SUMMARY OF THE INVENTION

These problems and others are addressed by embodiments of the present invention, a first aspect of which comprises an automatic pool cleaner that includes a housing having a bottom, an outer surface and an interior and at least two wheels connected to the housing and supporting the housing for rolling movement on a support surface with the bottom facing the support surface. A propulsion system is provided in the interior that is configured to move the pool cleaner along the support surface, and the cleaner includes a suction inlet. A scrubbing panel is connected to the housing and includes at least one flexible panel and a resilient stiffener connected to the flexible panel for biasing a planar portion of the flexible panel against the support surface when the wheels support the housing on the support surface.

Another feature of the invention comprises an automatic pool cleaner having a housing with a bottom, an outer surface and an interior and at least two wheels connected to the housing and supporting the housing for rolling movement on a support surface with the bottom facing the support surface. A suction inlet is provided in the housing, and a propulsion system is located in the interior of the housing to move the pool cleaner along the support surface. An arrangement for scrubbing the support surface is also provided that is connected to the housing and that has a planar face configured to contact the support surface when the at least two wheels support the housing on the support surface.

A further feature of the invention comprises an automatic pool cleaner with a housing having a bottom, an outer surface and an interior and at least two wheels connected to the housing and supporting the housing for rolling movement on a support surface with the bottom facing the support surface. A propulsion system is provided in the interior that is configured to move the pool cleaner along the support surface, and a suction inlet is also provided. A scrubbing panel is connected to the cleaner and is formed of first and second non-metallic, overlapping sheets of open non-woven fibers and a resilient stiffener mounted between the first and second sheets for biasing a first portion of the scrubbing panel against the support surface. A holder connects the scrubbing panel to the housing, and the holder has a channel portion receiving a first edge of the scrubbing panel and a portion of the resilient stiffener and a flange connected to the channel that mounts on an outer wall of the housing. The scrubbing panel is configured such that, when the wheels support the housing on the support surface, a second portion of the scrubbing panel extends across a gap between the housing and the support surface, and the first portion of the scrubbing panel overlies a portion of the support surface adjacent to the pool cleaner.

BRIEF DESCRIPTION OF THE DRAWINGS

These aspects and features of the invention and others will be better understood after a reading of the following detailed description together with the following drawings wherein.

DETAILED DESCRIPTION

Figure 1:
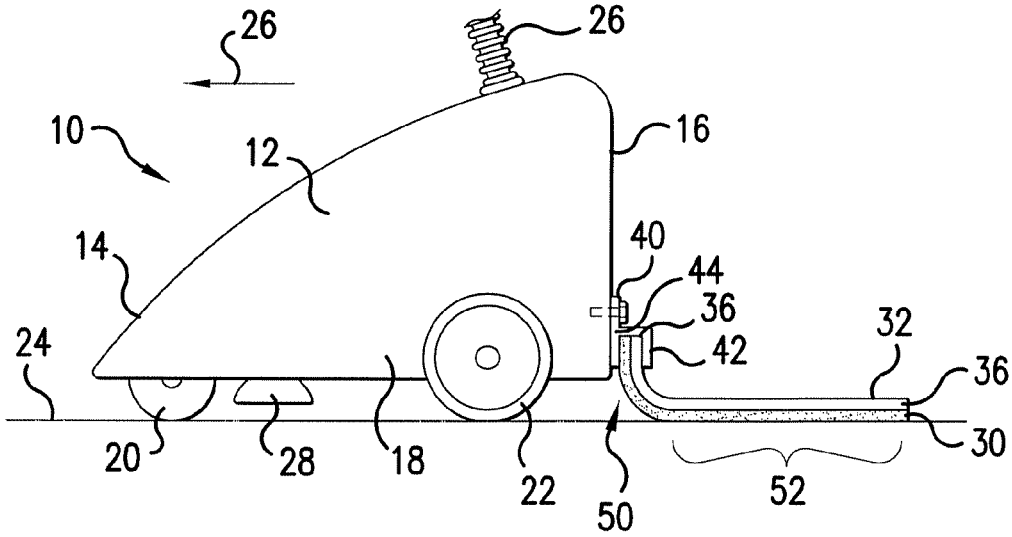
FIG. 1 is a side elevational view of an automatic pool cleaner with a scrubbing panel according to a first embodiment of the present invention.

Referring now to the drawings, wherein the showings are for purposes of illustrating embodiments of the invention only and not for the purpose of limiting same, FIG. 1 illustrates an automatic pool cleaner 10 having a housing 12 with a front 14, a rear 16 and a bottom 18. Cleaner 10 is supported by a front wheel 20 and a pair of rear wheels 22 for rolling movement along the bottom 24 of a swimming pool. Part of one of the rear wheels 22 is broken away in FIG. 1 so that the scrubbing panel described hereafter can be more easily seen. A vacuum hose 26 connects to housing 12 and draws debris into housing 12 through a suction inlet 28 in bottom 18 of the pool cleaner. Housing 12 contains a conventional drive mechanism, not illustrated, for moving pool cleaner 10 along pool bottom 24 in a well-known manner. While the illustrated wheels make direct contact with pool bottom 24, wheels driving tank-like tracks could also be used without exceeding the scope of the present invention. Cleaner 10 is adapted to travel primarily in a forward direction, the direction of housing front 14, as illustrated by arrow 26 in FIG. 1.

Figure 2:
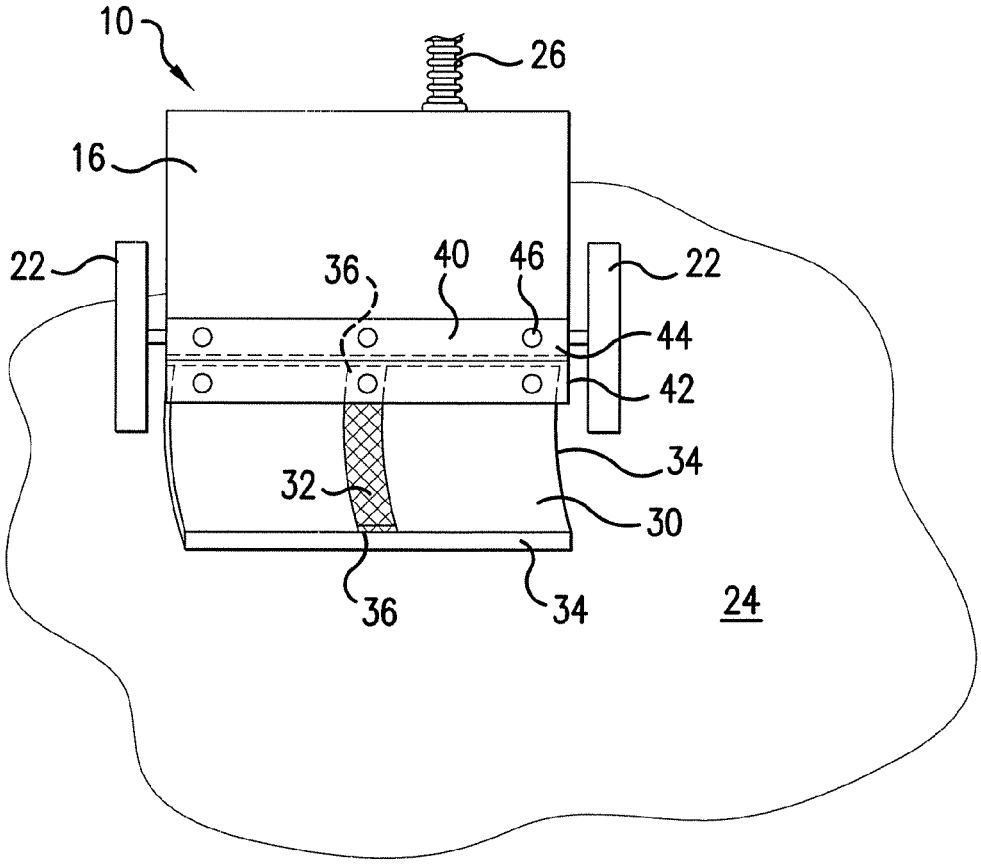
FIG. 2 is a rear elevational view of the automatic pool cleaner and scrubbing panel of FIG. 1.
Figure 3:
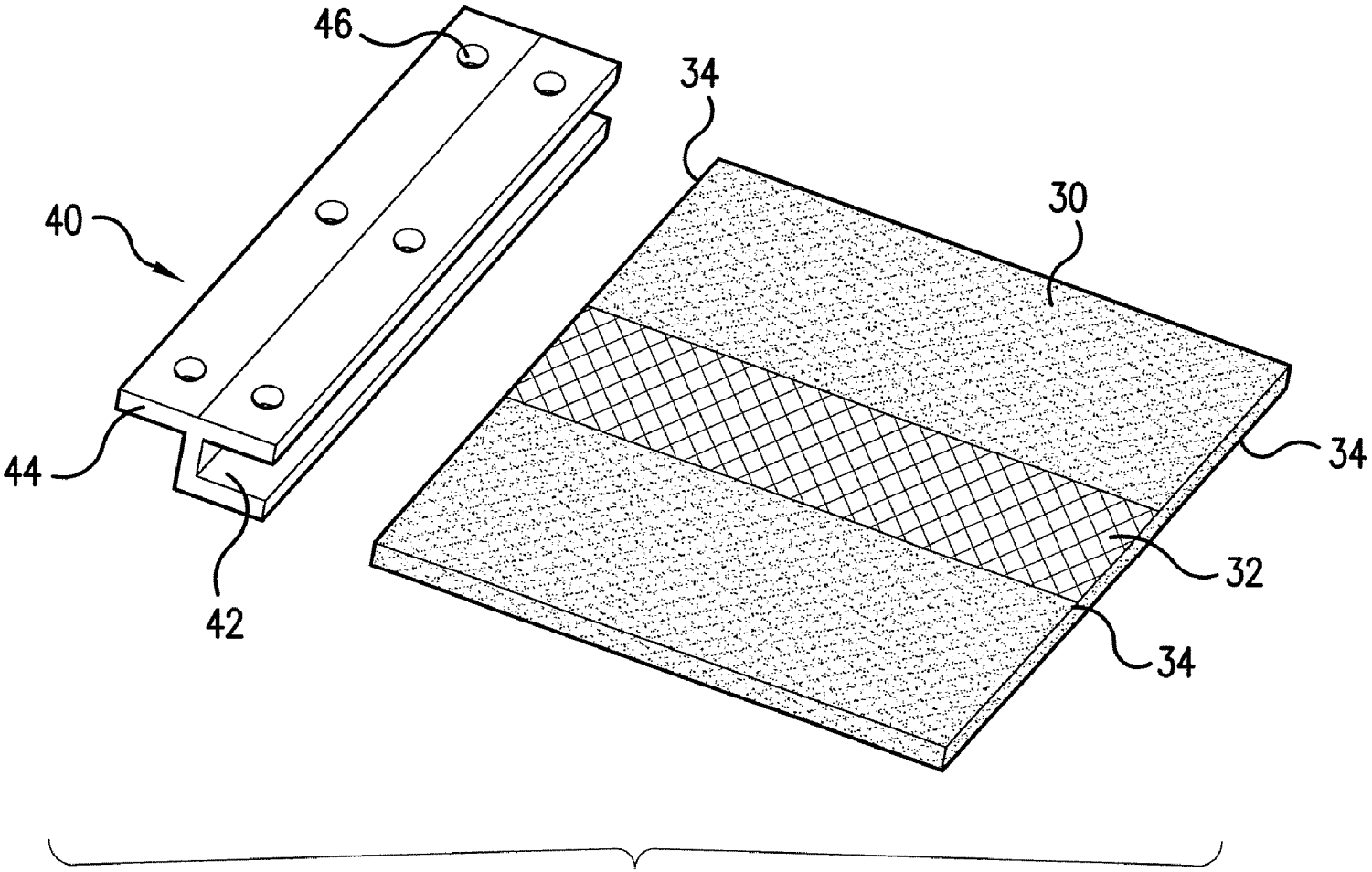
FIG. 3 is an exploded view of the scrubbing panel of FIG. 1 removed from the automatic pool cleaner.
Figure 6:
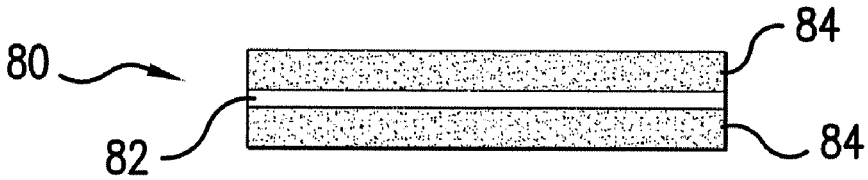
FIG. 6 is an end elevational view of a third alternative scrubbing panel attachable to the automatic pool cleaner of FIG. 1.

A scrubbing panel 30 is connected to rear 16 of housing 12 and dragged along pool bottom 24 as the cleaner 10 traverses a pool. Scrubbing panel 30 is formed from at least one layer of a non-metallic, non-woven, flexible fiber sheet having edges 34. Suitable pads are sold commercially as non-abrasive scrubbing or cleaning pads, and in this embodiment, a panel approximately 6 inches by 9 inches is used. A resilient stiffening element 32 having ends 36 overlies a portion of the flexible sheet. The stiffening element 32 may have a lattice-like structure as illustrated in FIGS. 2 and 3 or may comprise a planar sheet of material as illustrated in FIG. 6. PVC has been found to have acceptable properties for a stiffener. Stiffening element 32 may optionally be glued or otherwise attached directly to scrubbing panel 30 or may be held adjacent panel 30 by a holder described below.

As illustrated in FIG. 3, a holder 40 is provided for connecting scrubbing panel 30 to housing 10. Holder 40 comprises a channel portion 42 and a flange 44 projecting therefrom. Flange 44 may be provided with a number of openings 46 through which fasteners many be inserted to connect holder 40 to rear 16 of housing 10, or, alternately, these openings 46 may be omitted and holder 40 can be connected to housing 10 using fasteners such as self-tapping screws (not shown). Holder 40 may be formed from any suitable material, such as PVC, that will withstand prolonged submersion in chlorinated pool water.

Scrubbing panel 30 is connected to holder 40 by inserting one edge 34 of the scrubbing panel in channel portion 42 together with one end 36 of the stiffener. Fasteners may be inserted through openings 46 in opposite sides of channel portion 42 and through the scrubbing panel 30 and resilient stiffener 32 to hold the scrubbing panel 30 in place. Alternately, the dimensions of the channel portion 42 and the thickness of the scrubbing panel 30 can be selected so that panel 30 can be slid into channel 42 in a direction parallel to the direction of channel 42 while ribs (not shown) at the edges of channel portion 42 make panel 30 difficult to remove in a direction perpendicular to the channel length.

With the scrubbing panel 30 secured in channel portion 42 of holder 40, holder 40 can be attached to rear 16 of pool cleaner housing 12. Flange 44 of holder 40 is mounted on rear 16 substantially parallel to rear 16 such that the opening of channel portion 42 faces away from housing 12 and toward the bottom 24 of the pool when the cleaner 10 is supported on the pool bottom 24. The length of scrubbing panel 30 is greater than the distance separating housing bottom 18 from pool bottom 24, and consequently scrubbing panel 30 must bend when cleaner 10 is placed on the bottom 24 of the pool and overlay a portion of pool bottom 24 adjacent pool cleaner 10. The scrubbing panel 30 thus includes a first portion 50 that does not contact pool bottom 24 and a second, planar portion 52 that makes contact with pool bottom 24 over a relatively large, planar area. Resilient stiffener 32 has an end 36 in the channel 42 and is bent when cleaner 10 is placed on bottom 24. The energy stored in bent stiffener 32 helps to hold second planar portion 52 of scrubbing panel 30 in contact with the floor 24 of the pool.

As the pool cleaner 10 traverses pool bottom 24, vacuuming up debris, scrubbing panel 30 is dragged behind the pool cleaner 10. Algae and bacteria that grow in the pool may have protective membranes that make them difficult to kill with chemicals alone. The scrubbing action produced by the movement of scrubbing panel 30 over the pool surfaces, however, breaks these membranes and either scrapes some of the algae and bacteria off the pool surface or leaves the bacteria and algae more susceptible to the chemicals used in a pool. Beneficially, scrubbing panel 30 can provide an early warning of an algae problem that may require chemical control. This is because, if algae is present in the pool, it will tend to accumulate on scrubbing panel 30 before it become visible on pool surfaces.

Scrubbing panel 30 may also loosen other material from the bottom 24 of the pool so that it can be vacuumed up by suction inlet 28 on subsequent passes of the cleaner 10. In addition, by partially blocking water inflow to suction inlet 28 from the rear of the pool cleaner 10, suction from the sides and front of the pool cleaner 10 will generally be increased and may thus provide improved cleaning action. Scrubbing panel 30 and holder 40 may be sold as original equipment on pool cleaners of various designs or alternately added by consumers as an after-market accessory.

Figure 4:
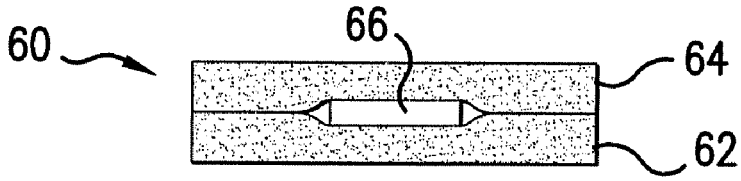
FIG. 4 is an end elevational view of a first alternate scrubbing panel attachable to the automatic pool cleaner of FIG. 1.

The scrubbing panel 30 of FIGS. 2 and 3 includes a single layer of non-woven material overlaid by a resilient stiffener 32. FIG. 4 illustrates an alternative scrubbing panel 60 comprising a first layer 62 of non-woven material, a second layer 64 of non-woven material, and a resilient stiffener 66 mounted therebetween. Such an arrangement allows for the secure retention of resilient stiffener 66 and may also allow scrubbing panel 60 to be reversed after first layer 62 of material is worn so that unused second layer 64 can provide additional scrubbing.

Figure 5:
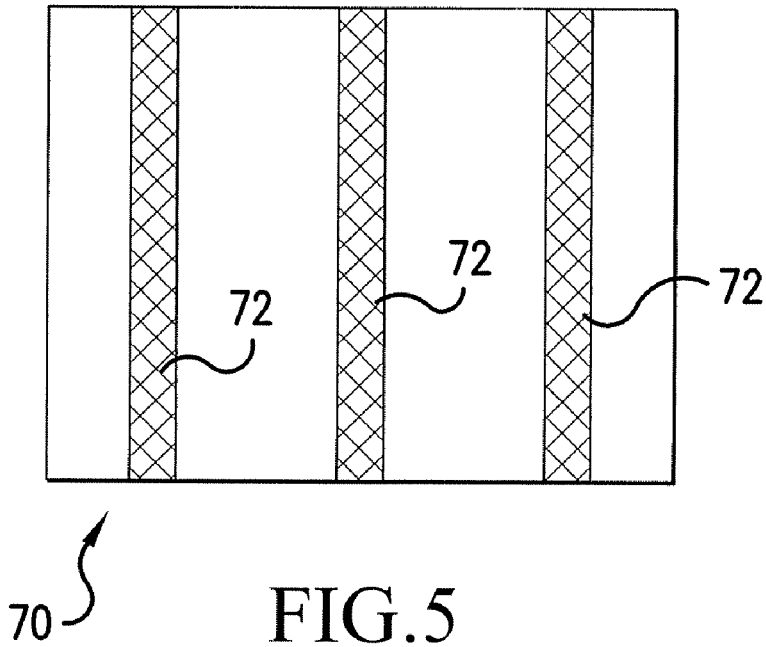
FIG. 5 is a top plan view of a second alternative scrubbing panel attachable to the automatic pool cleaner of FIG. 1.

FIG. 5 illustrates a scrubbing panel 70 having multiple resilient stiffening elements 72 for providing increased force against a pool bottom when scrubbing panel 70 is connected to a pool cleaner such as cleaner 10 using a holder such as holder 40.

FIG. 6 is an end view of an alternate scrubbing panel 80 that includes a sheet-like resilient stiffening element 82 that has a surface area substantially equal to the surface area of first and second scrubbing sheets 84.

Figure 7:
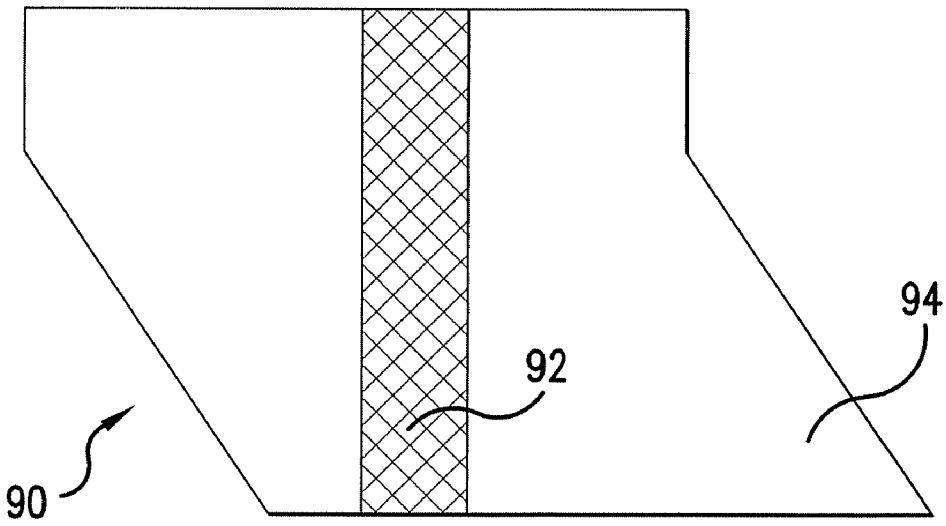
FIG. 7 is a top plan view of a fourth alternative scrubbing panel attachable to the automatic pool cleaner of FIG. 1.

FIG. 7 illustrates an alternate scrubbing panel 90 and stiffening element 92 that are generally similar to scrubbing panel 30 of FIGS. 2 and 3. However, scrubbing panel 90 includes an offset portion 94 for providing scrubbing action outside the wheel base of cleaner 10 thereby allowing corners and the lower portions of pool sidewalls to be scrubbed as a cleaner 10 moves along the bottom of the pool.

Figure 8:
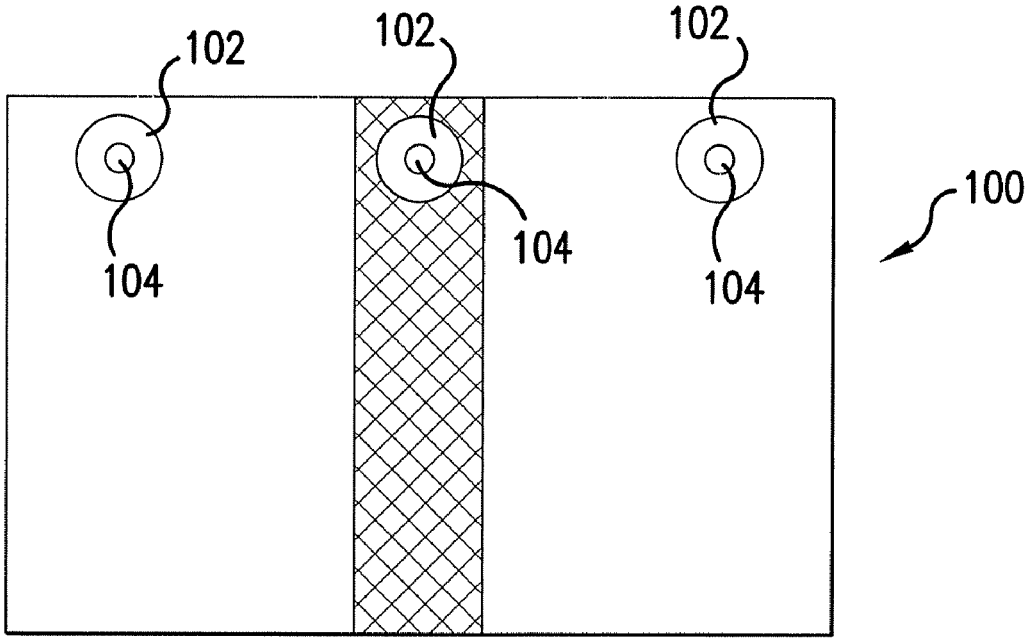
FIG. 8 is an end elevational view of a fifth alternative scrubbing panel attachable to the automatic pool cleaner of FIG. 1.
Figure 9:
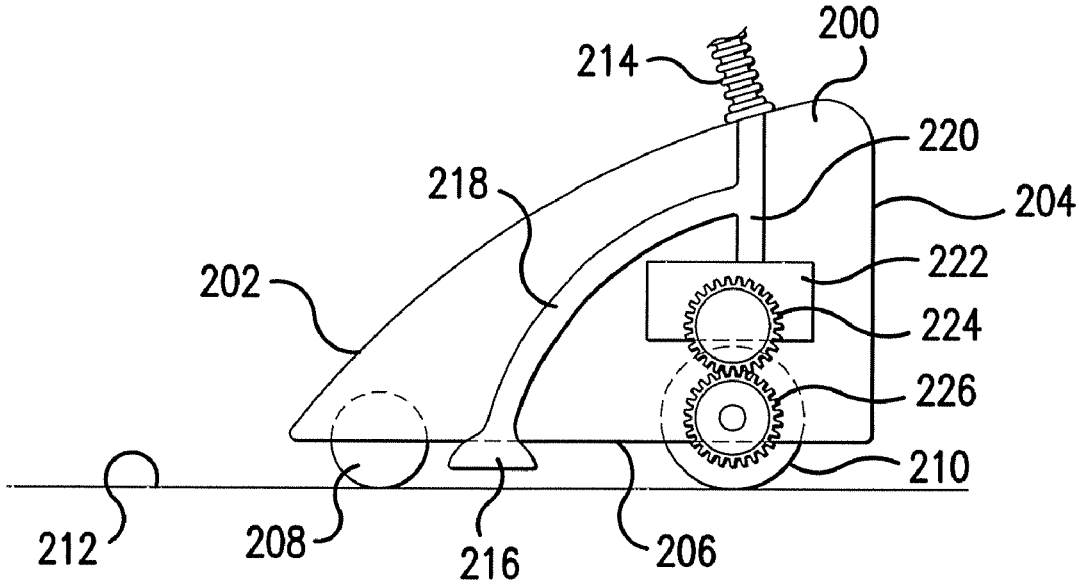
FIG.9 CONVENTIONAL ART
FIG. 9 is a sectional side elevational view of a conventional automatic pool cleaner.
Figure 10:
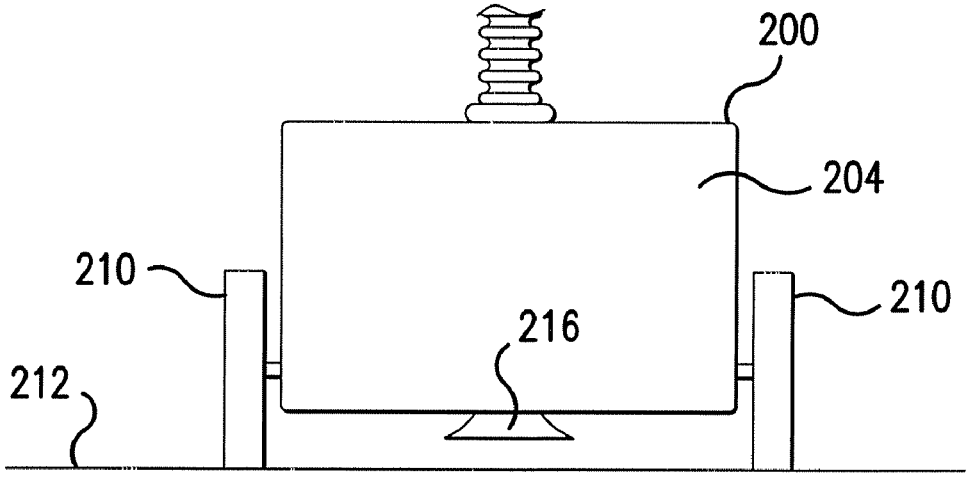
FIG.10 CONVENTIONAL ART
FIG. 10 is a rear elevational view of the conventional automatic pool cleaner of FIG. 9.

FIG. 8 illustrates yet another scrubbing panel 100. Panel 100 includes a plurality of reinforcing grommets 102 having openings 104 through which fasteners (not shown) may pass to secure scrubbing g panel 100 to housing 12 of a cleaner 10 without the use of a separate holder 40.

The present invention has been described herein in terms of several illustrated preferred embodiments. Various modifications and additions to these embodiments will become apparent to those skilled in the relevant arts upon a reading of the foregoing disclosure. It is intended that all such modifications and additions comprise a part of the present invention to the extent they come within the scope of the several claims appended hereto.

I claim:

1. An automatic pool cleaner comprising:

a housing having a bottom, an outer surface and an interior;

at least two wheels connected to the housing and supporting the housing for rolling movement on a support surface with said bottom facing the support surface;

a propulsion system in said interior configured to move the pool cleaner along the support surface;

a suction inlet; and a scrubbing panel connected to said housing, wherein said scrubbing panel comprises at least one flexible panel extending across said housing and partially blocking the flow of water to said suction inlet, and a resilient stiffener connected to said at least one flexible panel and configured to bias a planar portion of said at least one flexible panel against the support surface when the at least two wheels support the housing on the support surface.

2. The automatic pool cleaner of claim 1 wherein said at least one flexible panel comprises a non-woven fiber panel.

3. The automatic pool cleaner of claim 1 wherein said at least one flexible panel comprises an open, non-metallic, non-woven fiber.

4. The automatic pool cleaner of claim 1 wherein said at least one flexible panel comprises first and second flexible panels and wherein said resilient stiffener is mounted between said first and second panels.

5. The automatic pool cleaner of claim 1 including a holder having a first portion connected to said at least one resilient sheet and a second portion connected to said housing.

6. The automatic pool cleaner of claim 5 wherein said holder comprises a channel portion receiving an edge portion of said at least one flexible panel and a flange connected to said housing exterior.

7. The automatic pool cleaner of claim 6 wherein said resilient stiffener extends into said channel.

8. The automatic pool cleaner of claim 5 wherein said resilient stiffener is connected to said holder.

9. The automatic pool cleaner of claim 5 wherein said resilient stiffener comprises a lattice.

10. The automatic pool cleaner of claim 1 wherein when said wheels support the housing on the support surface, a first portion of the scrubbing panel extends across a gap between the housing and the support surface and a second portion of the scrubbing panel overlies a portion of the support surface adjacent to the pool cleaner.

11. The automatic pool cleaner of claim 10 wherein said resilient stiffener is connected to said housing and extends from said first portion to said second portion.

12. The automatic pool cleaner of claim 1 wherein said propulsion system is configured to drive said housing in a first direction and wherein said scrubbing panel extends from said housing in a second direction opposite to said first direction.

13. An automatic pool cleaner comprising:

a housing having a bottom, an outer surface and an interior;

at least two wheels connected to the housing and supporting the housing for rolling movement on a support surface with said bottom facing the support surface;

a propulsion system in said interior configured to move the pool cleaner along the support surface;

a suction inlet; and means for scrubbing the support surface, said means for scrubbing extending across the width of said housing and partially blocking water flow to said suction inlet, being connected to said housing and having a planar face configured to contact the support surface when the at least two wheels support the housing on the support surface.

14. The automatic pool cleaner of claim 13 wherein said means for scrubbing the support surface includes a flexible scrubbing panel and means for resiliently stiffening said flexible scrubbing panel.

15. An automatic pool cleaner comprising:

a housing having a bottom, an outer surface and an interior;

at least two wheels connected to the housing and supporting the housing for rolling movement on a support surface with said bottom facing the support surface;

a propulsion system in said interior configured to move the pool cleaner along the support surface;

a suction inlet;

a scrubbing panel comprising first and second non-metallic, overlapping sheets of open non-woven fibers and a resilient stiffener mounted between said first and second sheets for biasing a first portion of said scrubbing panel against the support surface; and a holder connecting said scrubbing panel to said housing, said holder comprising a channel portion receiving a first edge of said scrubbing panel and a portion of said resilient stiffener and a flange connected to said channel and mounted on said housing outer wall;

wherein said scrubbing panel is configured such that, when said wheels support the housing on the support surface, a second portion of the scrubbing panel extends across a gap between the housing and the support surface and at least partially blocks water flow through said gap to the suction inlet and the first portion of the scrubbing panel overlies a portion of the support surface adjacent to the pool cleaner.

* * * * *